US010209725B2

(12) United States Patent
Zeng

(10) Patent No.: US 10,209,725 B2
(45) Date of Patent: Feb. 19, 2019

(54) CURRENT LIMITING CIRCUIT

(71) Applicant: STMicroelectronics (Shenzhen) R&D Co. Ltd, Shenzhen (CN)

(72) Inventor: Ni Zeng, Shenzhen (CN)

(73) Assignee: STMicroelectronics (Shenzhen) R&D Co. Ltd., Shenzhen (CN)

( * ) Notice: Subject to any disclaimer, the term of this patent is extended or adjusted under 35 U.S.C. 154(b) by 0 days.

(21) Appl. No.: 15/675,872

(22) Filed: Aug. 14, 2017

(65) Prior Publication Data

US 2018/0017983 A1 Jan. 18, 2018

Related U.S. Application Data

(63) Continuation of application No. 14/267,957, filed on May 2, 2014, now Pat. No. 9,778,670.

(30) Foreign Application Priority Data

May 6, 2013 (CN) ..... 2013 1 0166900

(51) Int. Cl.
*G05F 1/573* (2006.01)

(52) U.S. Cl.
CPC ..... *G05F 1/573* (2013.01)

(58) Field of Classification Search
CPC ..... G05F 1/56; G05F 1/573
USPC ..... 323/271, 273–281, 311–317
See application file for complete search history.

(56) References Cited

U.S. PATENT DOCUMENTS 4,950,976 A * 8/1990 Wagoner ..... G05F 1/565 323/312
6,055,149 A 4/2000 Gillberg et al.
7,113,412 B2 9/2006 Shao et al.
7,183,755 B2 * 2/2007 Itoh ..... G05F 1/5735 323/274
7,511,464 B2 * 3/2009 Suzuki ..... G05F 1/56 323/275
7,755,337 B2 * 7/2010 Negoro ..... G05F 1/565 323/277

(Continued)

FOREIGN PATENT DOCUMENTS

CN 203350758 U 12/2013

OTHER PUBLICATIONS

First Office Action for CN Appl. No. 201310166900.9 dated Apr. 27, 2015 (5 pages).

*Primary Examiner* — Kyle J Moody
(74) *Attorney, Agent, or Firm* — Crowe & Dunlevy

(57) ABSTRACT

A current limiting circuit includes a current sensing module that is configured to sense an output current of a power transistor and to generate a corresponding sensing current which is proportional to the output current. A first current limiting module coupled to the current sensing module is configured to generate a first limiting current based on the sensing current when a variation of the output current of the power transistor exceeds a first current level. A second current limiting module coupled to the current sensing module is configured to generate a second limiting current based on the sensing current when a variation of the output current of the power transistor exceeds a second current level. A converting module coupled to the first and second current limiting modules and the power transistor controls a gate voltage of the power transistor based at least on the first and second limiting currents.

18 Claims, 3 Drawing Sheets

(56) References Cited

U.S. PATENT DOCUMENTS

| | | | |
|---|---|---|---|
| 7,816,897 | B2 | 10/2010 | Illegems |
| 8,044,653 | B2 | 10/2011 | Maige et al. |
| 8,169,204 | B2 | 5/2012 | Jian |
| 8,232,781 | B2 | 7/2012 | Marino et al. |
| 2004/0004466 | A1 | 1/2004 | Miyanaga et al. |
| 2014/0184182 | A1 | 7/2014 | Yajima et al. |
| 2014/0253070 | A1 | 9/2014 | Sakaguchi |
| 2014/0266107 | A1 | 9/2014 | Zhou et al. |
| 2015/0177752 | A1 | 6/2015 | Nakashimo et al. |

* cited by examiner

CURRENT LIMITING CIRCUIT

CROSS REFERENCE TO RELATED APPLICATIONS

This application is a continuation of U.S. patent application Ser. No. 14/267,957 filed May 2, 2014, which claims priority from Chinese Application for Patent No. 201310166900.9 filed May 6, 2013, the disclosures of which are incorporated by reference.

TECHNICAL FIELD

This invention relates generally to electronic circuits, and more particularly current limiting circuits.

BACKGROUND

Power supply circuits usually have a configuration containing a high side power MOS transistor and/or a low side power MOS transistor. The high side power MOS transistor may be coupled between a supply node for receiving a supply voltage and an output node for providing the supply voltage, and the low side power MOS transistor may be coupled between the output node and a reference node for receiving a reference voltage which is lower than the supply voltage. These two power MOS transistors may be turned on or off to selectively supply power to external loads.

Inductive external loads require a stable output to avoid oscillation. Therefore, current limiting circuits are widely used in power supply circuits to limit the output current of power supply circuits.

FIG. 1 shows a conventional current limiting circuit. As shown in FIG. 1, a high side power PMOS transistor MP1 is coupled between a supply voltage VINHSD and an output node HSD to provide the supply voltage to external loads. A current source Ib1 and a resistor R2 are coupled in series between the supply voltage and ground. The current provided by current source Ib1 is determined by a resistor (not shown; referred to as R1) and a band gap reference voltage $V_{BG}$. The voltage at a node G1 at which R2 and Ib1 are coupled with each other is applied to a gate terminal of Mp1 via a resistor R3.

Moreover, a PNP bipolar transistor Q4 and a diode D1 are coupled in series (between VINHSD and node G1), and together in parallel with the second resistor R2, with an emitter terminal of Q4 coupled to VINHSD.

A current mirror having a first branch and a second branch is coupled between the supply voltage VINHSD and ground. The first branch has a resistor R4, a PNP bipolar transistor Q1 and a current source Ib3 coupled in series, wherein R4 is coupled between VINHSD and an emitter terminal of Q1, and Ib3 is coupled between a collector terminal of Q1 and ground. The second branch has a PNP bipolar transistor Q2 and a current source Ib2 coupled in series, wherein an emitter terminal of Q2 is coupled with VINHSD, and Ib2 is coupled with ground. Base terminals of Q1 and Q2 are coupled together and further coupled to a collector terminal of Q2.

R4 is also coupled between the supply voltage VINHSD and a source terminal of PMOS high side power transistor MP1. The base terminal of Q4 is coupled to a collector terminal of Q1. Specifically, the current provided by Ib2 is identical to current provided by Ib3. Current gain ratio of transistor Q1 and Q2 is N:1, wherein N is an integer no less than 1.

In operation, resistor R4 may function as a current sensing resistor for sensing the output current flowing through the high side power PMOS transistor MP1. Changes of output current may cause changes of voltage drop across resistor R4, and may consequently be rippled to influence the voltage at node G1 through the current mirror and bipolar transistor Q4. Therefore, the gate-source voltage of the high side power PMOS transistor MP1 may be adjusted which may limit the output current of MP1 accordingly.

Thus, the output current supplied by the high side power PMOS transistor MP1 can be limited to $$I_{load} = \frac{V_T}{R_4}\ln N.$$

The current limiting circuit in FIG. 1 is a high gain loop which is configured to adjust the output current of MP1 when a sudden peak appears. However, such a configuration may suffer from stableness problem since the limiting circuit may drag the output current to negative and cause oscillation. Therefore, a branch including a resistor R5 and a capacitor C1 coupled in series is needed for compensation, wherein R5 is coupled with VINHSD and C1 is coupled to the base terminal of Q4. But compensation may lower the response speed of the current limiting process.

FIG. 2 shows another conventional current limiting circuit. Slightly different from the current limiting circuit in FIG. 1, the current limiting circuit in FIG. 2 includes a bipolar transistor Q3 in place of the compensation branch including resistor R5 and capacitor C1, wherein base terminals of Q3 and Q4 and a collector terminal of Q3 are coupled to the collector terminal of Q1. The current gain ratio of Q3 and Q4 is M:1, wherein M is an integer no less than 1. The current limiting circuit in FIG. 2 is a low gain loop which has a better stability than the current limiting circuit in FIG. 1 but suffers from a relatively slow response.

Both of the above two conventional current limiting circuits employ R4 as a sensing resistor to sense changes of the output current of the power transistor. The voltage drop across resistor R4 should be tens of mV to ensure the reliability of the current limiting circuits. However, in order to pass a short-to-plus-unpowered (SPU) test (generally greater than 100 A), the resistance of resistor R4 may only be around 2 mΩ. Therefore, under such a condition, resistor R4 cannot generate a suitable voltage drop to avoid reliability issue when the output current is limited to around 1 A.

Also, using R4 to sense the output current change may increase the on-resistance when providing the supply voltage to the external loads.

FIG. 3 shows another conventional current limiting circuit. As shown in FIG. 3, the current limiting circuit has a high side power PMOS transistor Mp1 and a PMOS transistor M2 forming a current mirror which has a current gain determined by width-to-length ratios of the two transistors, for example the width-to-length ratio of Mp1 may be K times that of M2. The gate and drain terminals of M2 are coupled together with a current source Ib. Therefore, the voltage at a gate terminal of the power PMOS transistor Mp1 is determined by the current source Ib as well as the width-to-length ratios of Mp1 and M2. In this way, the output current flowing through the high side power MOS transistor Mp1 can be limited to $I_{load}=I_bK$.

Even though the current limiting circuit in FIG. 3 may accurately limit the output current of the power transistor, such a current limiting circuit has a high on-resistance when providing the supply voltage to external loads which is not preferred due to high power consumption.

SUMMARY

Due to the issues stated above, there is a need for a current limiting circuit for accurately limiting output current of a power transistor with improved stability and response speed without increasing the on-resistance of the power supply circuit.

In an embodiment, a circuit for limiting an output current of a power transistor comprises: a current sensing module configured to sense an output current of the power transistor and generate a sensing current in proportion to the output current of the power transistor; a first current limiting module coupled to the current sensing module and configured to generate a first limiting current based on the sensing current when variation of the output current of the power transistor exceeds a first current level; and a converting module coupled to the first current limiting module and the power transistor and configured to control a gate voltage of the power transistor based at least on the first limiting current.

The current limiting circuit further comprises a second current limiting module coupled to the current sensing module and configured to generate a second limiting current based on the sensing current when the variation of the output current of the power transistor exceeds a second current level; wherein the converting module is coupled to the second current limiting module and configured to control the gate voltage of the power transistor based at least on the first and second limiting currents; and wherein the second current level is higher than the first current level.

The first and second current limiting modules are coupled with the current sensing module through a first current mirror comprising an input branch configured to receive the sensing current, a first output branch coupled with the first current limiting module, and a second output branch coupled with the second current limiting module.

The converting module comprises a first resistor and a first current source coupled in series, and a gate terminal of the power transistor is coupled to a node at which the first resistor and the first current source are coupled together; wherein the first current limiting module comprises a second current mirror comprising an input branch coupled with the first output branch of the first current mirror, an output branch coupled in parallel with the first resistor, and a second current source coupled in parallel with the input branch of the second current mirror; and wherein the first current level is at least set by the second current source.

The second current limiting module comprises an input branch coupled with the second output branch of the first current mirror, and an output branch coupled in parallel with the first resistor; wherein the input branch of the second current limiting module comprises at least a third current source and the output branch of the second current limiting module comprises a first transistor coupled in series with a first voltage clamping module; wherein the third current source is coupled to a gate of the first transistor, and the second current level is at least set by the third current source.

The output branch of the first current limiting module further comprises a second voltage clamping module.

The first voltage clamping module comprises two diodes coupled in series, and the second voltage clamping module comprises a second transistor with a gate terminal and a drain terminal coupled together.

The current limiting circuit further comprises a second resistor coupled between the gate of the power transistor and the first resistor.

The current limiting circuit further comprises a second power transistor with a gate coupled with the gate of the power transistor and configured to form a third current mirror with the power transistor.

The current sensing module comprises a first input branch coupled in series with the power transistor, a second input branch coupled in series with the second power transistor, an output branch coupled between the second power transistor and the first current limiting module, and a fourth current source coupled between an internal voltage supply and the first current limiting module; wherein the first input branch of the current sensing module comprises a third transistor coupled in series with a fifth current source, the second input branch of the current sensing module comprising a fourth transistor coupled in series with a sixth current source, the output branch of the current sensing module comprising a fifth transistor; wherein a gate terminal of the third transistor together with a gate terminal of the fourth transistor are coupled to a drain terminal of the fourth transistor, and a drain terminal of the third transistor is coupled to a gate terminal of the fifth transistor, and the fourth current source is coupled to a drain terminal of the fifth transistor and further to the first current limiting module.

By using the current limiting circuit in accordance with embodiments of the present application, the sensing resistor of the prior art is replaced by a current sensing module, which enables the direct use of the output current to adjust the gate-source voltage of the power transistor without being converted to voltage signals. Therefore, accuracy of the current limiting process is improved Also in embodiments of the present application, a low gain current limiting module and a high gain current limiting module are coupled in parallel to adjust the gate-source voltage of the power transistor, which provides an increased range of the output current that can be adjusted. Also, the response speed of the current limiting circuit is improved without degrading the stability.

Further, by replacing the sensing resistor with the current sensing module, and together with using the low gain and/or high gain current limiting module, the on-resistance of the current limiting circuit is reduced.

In an embodiment, a method comprises: generating a gate voltage at a node in response to a constant reference current, said gate voltage applied to a gate terminal of a power transistor; sensing an output current generated by the power transistor to generate a control current that is proportional to the sensed output current; generating a first limiting current based on the control current; generating a second limiting current based on the control current; determining when a variation in the sensed output current exceeds a first threshold and in response thereto applying the first limiting current to said node; and determining when a variation in the sensed output current exceeds a second threshold and in response thereto applying the second limiting current to said node.

In an embodiment, a method comprises: generating a gate voltage at a node for application to a gate terminal of a power transistor; sensing an output current generated by the power transistor at an output node; generating a first limiting current for application to said node, wherein generating the first limiting current comprises: applying a bias current to the node having a minimum magnitude; sinking a sink current from the having said minimum magnitude; and increasing the magnitude of the bias current in response to a sensed change in the output current exceeding a first threshold; generating a second limiting current for application to said node, wherein generating the second limiting current comprises: deactivating a current generator supplying the second limiting current if a sensed change the output current is less than a second threshold; and activating said current generator supplying the second limiting current in response to the sensed change in the output current exceeding the second threshold.

BRIEF DESCRIPTION OF THE DRAWINGS

For a more complete understanding of the present disclosure, and the advantages thereof, reference is now made to the following descriptions taken in conjunction with the accompanying drawings, in which.

DETAILED DESCRIPTION OF THE DRAWINGS

Corresponding numerals and symbols in different figures generally refer to corresponding parts unless otherwise indicated. The figures are drawn to clearly illustrate the relevant aspects of embodiments of the present disclosure and are not necessarily drawn to scale. To illustrate certain embodiments more clearly, a letter indicating variations of the same structure, material, or process step may follow a figure number.

The making and using of embodiments of the present application are discussed in detail below. It should be appreciated, however, that the present invention provides many applicable inventive concepts that may be embodied in a wide variety of specific contexts. The specific embodiments discussed are merely illustrative of specific ways to make and use the invention, and do not limit the scope of the invention.

In the current limiting circuits introduced below, PMOS high side power transistors are used as an example for description purpose. People of ordinary skill in the art understand how to establish limiting circuits using complement types of power transistors given what is introduced in the present disclosure.

Figure 1:
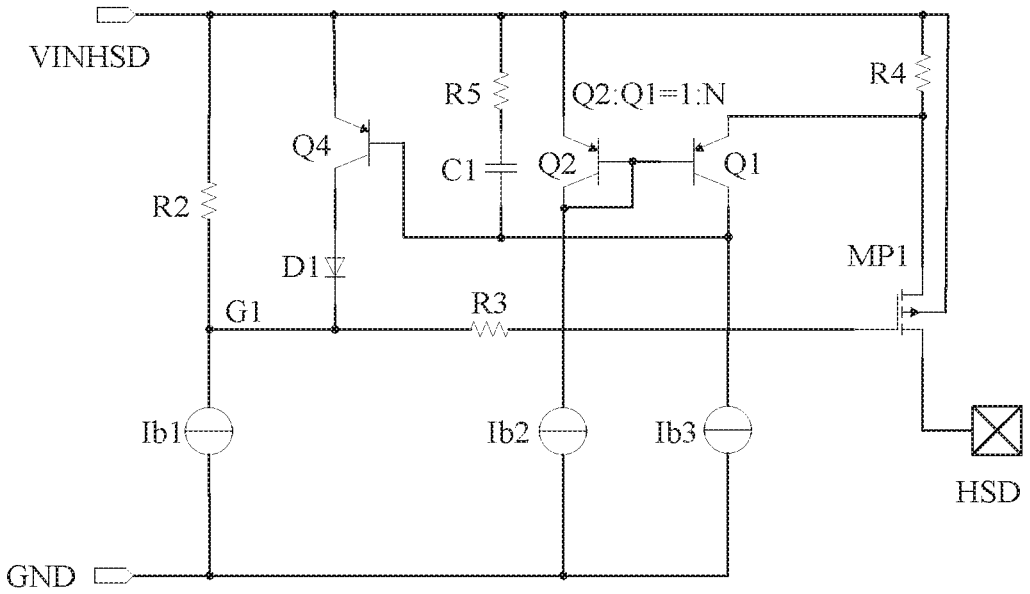
Fig. 1 (Prior Art)
FIG. 1 shows a conventional current limiting circuit.
Figure 2:
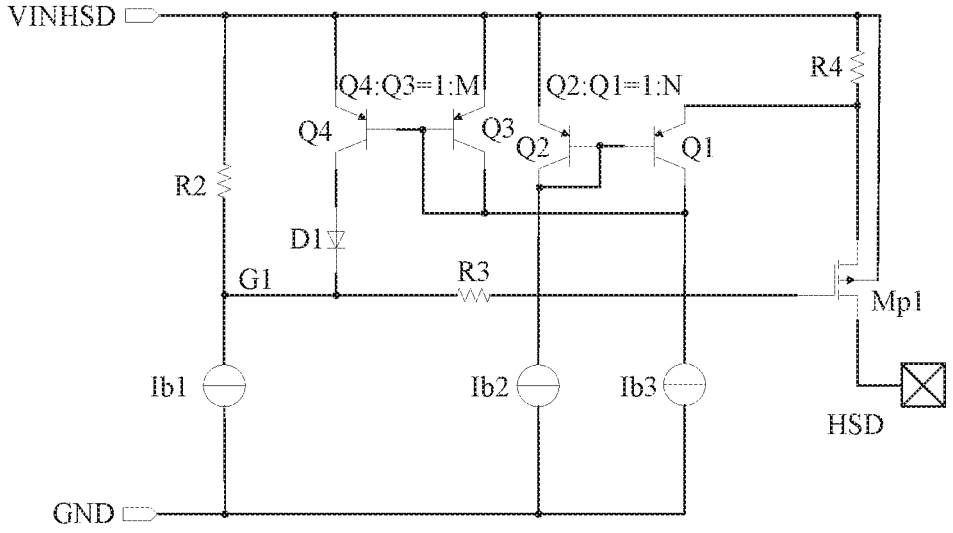
Fig. 2 (Prior Art)
FIG. 2 shows another conventional current limiting circuit.
Figure 3:
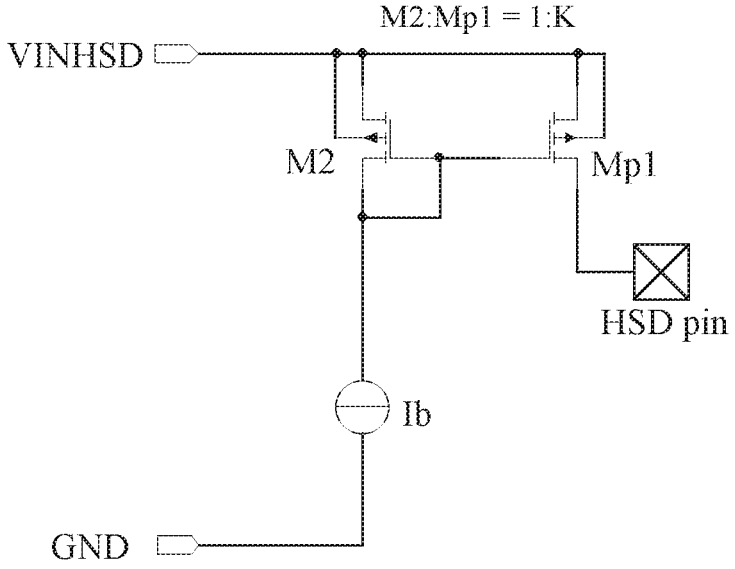
Fig. 3 (Prior Art)
FIG. 3 shows yet another conventional current limiting circuit.
Figure 4:
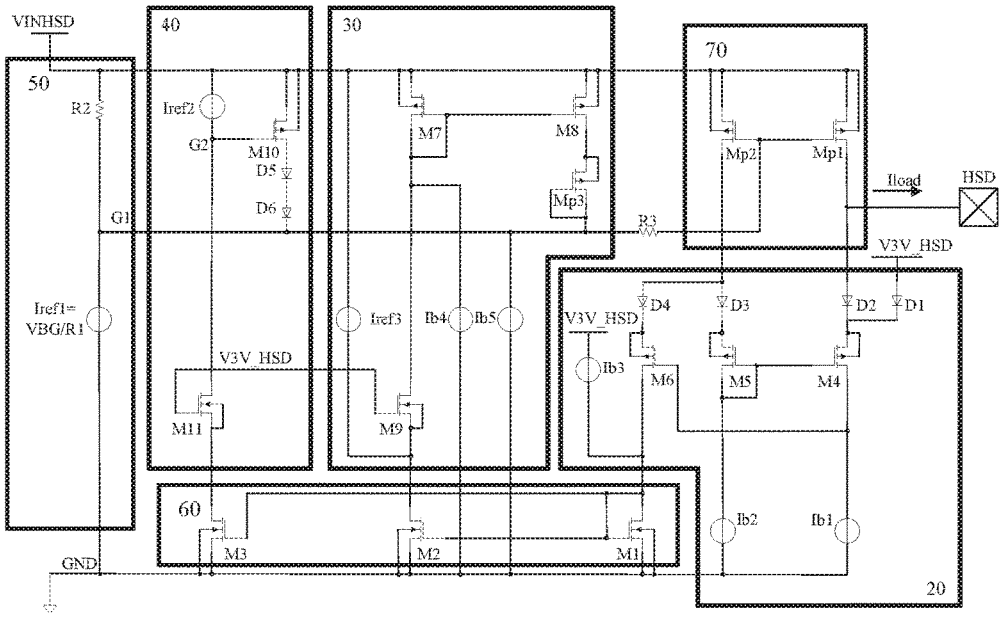
FIG. 4 shows a current limiting circuit according to an embodiment of the present application.

FIG. 4 shows a current limiting circuit according to one embodiment of the present application. The circuit may comprise a current sensor 20, a low gain current limiting module 30 and/or a high gain current limiting module 40, and a converting module 50.

PMOS power transistor Mp1 has a source terminal coupled to a supply voltage VINHSD and a drain terminal coupled to an output node HSD. In one embodiment, power transistor Mp1 is paired with a power transistor Mp2 to form a current mirror 70, with gate terminals of the two power transistors coupled with each other. In one embodiment, the width-to-length ratio of Mp1 may be K times of that of Mp2. Therefore, $I_{Mp1}$ may be K times of $I_{Mp2}$.

Current sensing module 20 is coupled with current mirror 70 and configured to sense changes of the output current $I_{load}$ accordingly. In one embodiment, current sensing module 20 comprises a first branch having a current source $I_{b1}$ coupled to the drain terminal of Mp1, and a second branch having current source $I_{b2}$ coupled to a drain terminal of Mp2. These two current sources are used to keep power transistors Mp1 and Mp2 in an on-state even if the output node HSD is shorted to ground, and to avoid oscillation caused by turning on and off of power transistor Mp1.

Additionally, the first branch of current sensing module 20 further includes a PMOS transistor M4 functioning as an operational amplifier, with a source terminal coupled to the drain terminal of power transistor Mp1 and with a drain terminal coupled to current source $I_{b1}$. The second branch further comprises a PMOS transistor M5 with a source terminal coupled with a drain terminal of power transistor Mp2 and with a drain terminal coupled with current source $I_{b2}$. Gate terminals of PMOS transistors M4 and M5 are coupled to the drain terminal of M5.

Current sensing module 20 further comprises a third branch to output the sensing current $I_{M1}$. The third branch comprises a PMOS transistor M6 with a source terminal coupled to the drain terminal of power transistor Mp2, and with a drain terminal coupled to low gain current limiting module 30. In one embodiment, M5 and M6 are used to match M4 and may function as operational amplifiers too. In one embodiment, M4 and M5 have the same width-to-length ratios.

Current sensing module 20 further comprises a current source $I_{b3}$ coupled between the drain terminal of M6 and an internal voltage supply V3V_HSD. Current source $I_{b3}$ is configured to keep low gain current limiting module 30 in an on state even if there are no changes of the output current sensed by current sensing module 20. Thus, the response speed of the current limiting circuit may be increased.

According to the above description, the sensing current $I_{M1}$ and the output current $I_{load}$ of power transistor Mp1 may be expressed as follow:

$$I_{Mp1}=I_{load}+I_{b1} \tag{1}$$

$$I_{Mp2}+I_{b3}=I_{b2}+I_{M1} \tag{2}$$

wherein K may be assigned a large value, such as 1000, values of current source $I_{b1}$, $I_{b2}$ and $I_{b3}$ may be very small, for example may be of the order of microampere (μA), and may be configured as $I_{b1}=I_{b2}=I_{b3}$, therefore a proportional relationship between $I_{M1}$ and $I_{load}$ may be described as follow:

$$I_{M1}\approx I_{Mp2}=(I_{load}+I_{b1})/K\approx I_{load}/K \tag{3}$$

In other embodiments, when the voltage at HDS is very low or the supply voltage VINHSD is very low, current sensing module 20 further comprises a diode D1 forwardly coupled between an internal voltage supply V3V_HSD and the source terminal of transistor M4. D1 is configured to help transistors in current sensing module 20 to operate in the saturation region, therefore to reduce variation of the output current $I_{load}$.

In some applications, the voltage at HDS may go to negative. Under such a situation, current sensing module 20 further comprises a diode D2 forwardly coupled between the drain terminal of Mp1 and the source terminal of M4. Therefore, a diode D3 forwardly coupled between the drain terminal of Mp2 and source terminal of M5, and a diode D4 forwardly coupled between the drain terminal of Mp2 and the source terminal of M6 are used to match D2. In one embodiment, D2, D3 and D4 may be of the same value.

In one embodiment, the sensing current $I_{M1}$ is provided to low gain current limiting module 30 and/or high gain current limiting module 40 via a current mirror 60. In one embodiment, current mirror 60 comprises an input branch having an NMOS transistor M1 with a drain terminal couple to the drain terminal of M6 and configured to receive the sensing current $I_{M1}$, and with a source terminal couple to ground. Current mirror 60 further comprises a first output branch having an NMOS transistor M2 and a second output branch having an NMOS transistor M3. Gate terminals of M1, M2 and M3 are coupled to the drain terminal of M1. Drain terminals of M2 and M3 are configured to respectively provide currents $I_{M2}$ and $I_{M3}$ which are proportional to the sensing current $I_{M1}$ to low gain current limiting module 30 and high gain current limiting module 40. In one embodiment, the width-to-length ratios of M1, M2 and M3 may be N:1:1, therefore $I_{M1}=N*I_{M2}=N*I_{M3}$, wherein N may be in integer no less than 1.

In various embodiments, low gain current limiting module 30 comprises PMOS transistor M7 with a source terminal coupled to the supply voltage VINHSD and a drain terminal coupled with the drain terminal of M2 to receive $I_{M2}$ which is proportional to the sensing current $I_{M1}$. M7 is paired with another PMOS transistor M8 which has a source terminal coupled with the supply voltage VINHSD and a drain terminal coupled to the gate terminal of power transistor Mp1, to form a current mirror having gate terminals of M7 and M8 coupled to the drain terminal of M7. In one embodiment, the width-to-length ratios of M7 and M8 may be 1:M*N, therefore $I_{M8}=M*N*I_{M7}$.

Low gain current limiting module 30 further comprises a current source $I_{ref3}$ coupled between the supply voltage VINHSD and the drain terminal of M2. In various embodiments, current source $I_{ref3}$ is tunable to define a desired current level of the output current of power transistor Mp1. Currents flowing through $I_{M7}$ and $I_{M8}$ may be described as follow:

$$I_{M7} = \frac{1}{N} I_{M1} - I_{ref3} \tag{4}$$

$$I_{M8} = MN\left(\frac{1}{N} I_{M1} - I_{ref3}\right) = M(I_{M1} - NI_{ref3}) \tag{5}$$

The low gain current limiting module further comprises a current source $I_{b4}$ coupled between the drain terminal of PMOS transistor M7 and ground, configured to keep transistor M7 in an on-state even if there is no sensing current received or the sensing current is very small. A current source $I_{b5}$ is coupled between the drain terminal of transistor M8 and ground to match $I_{b4}$.

Additionally, low gain current limiting module 30 further comprises a voltage clamping module coupled between the drain terminal of M8 and the gate terminal of power transistor Mp1. In one embodiment, the voltage clamping module may be a PMOS power transistor Mp3 with its gate terminal and drain terminal coupled together to the gate terminal of power transistor Mp1. Using power transistor Mp3 as the voltage clamping module accurately separates the gate voltage of Mp1 from the supply voltage VINHSD to avoid turning off Mp1 when there is a large current through M8.

Converting module 50 comprises a resistor R2 with one end coupled to the supply voltage VINHSD and another end coupled to ground via a current source $I_{ref1}$ The gate terminal of power transistor Mp1 is coupled to a node G1 at which resistor R2 and current source $I_{ref1}$ are coupled together. In one embodiment, the current provided by $I_{ref1}$ may be determined by a resistor (not shown; referred to as R1) and a band gap reference voltage $V_{BG}$.

$$I_{ref1}=V_{BG}/R_1 \tag{6}$$

Therefore, voltage at the gate terminal of power transistor Mp1 is the same as the voltage drop across R2 and may be expressed as follow:

$$V_{gs(Mp1)}=R_2(I_{ref1}-I_{M8}) \tag{7}$$

In operation, when the output current $I_{load}$ at HSD increases, the sensing current $I_{M1}$ also increases, and consequently the limiting current $I_{M8}$ generated by current limiting module 30 also increases. However, the current provided by current source $I_{ref1}$ is constant. Therefore, current flowing through R2 decreases leading to a decrease of voltage drop across R2, which means a decrease of the gate-source voltage of Mp1, and the output current $I_{load}$ is therefore decreased.

Considering the above equations, the output current of the power transistor limited by the low gain loop may be expressed as follow:

$$I_{load_lowgain} = \left(NI_{ref3} + \frac{V_{BG}\frac{R_2}{R_1} - V_{gs(Mp1)}}{MR_2}\right) * K \approx KNI_{ref3} \tag{8}$$

wherein $R_1$, $R_2$, and $V_{BG}$ are of constant values. In various embodiments, the values of M, N and K may be very large, therefore the value of the output current $I_{load}$ may be dominantly defined by tuning the value of $I_{ref1}$.

Alternatively, current limiting circuit 100 further comprises a high gain current limiting module 40 coupled in parallel with low gain current limiting module 30. Specifically, high gain current limiting module 40 comprises a current source $I_{ref2}$ coupled between VINHSD and the drain terminal of transistor M3. High gain current limiting module 40 further comprises a PMOS transistor M10 with its source terminal coupled to VINHSD, its drain terminal coupled to the gate terminal of power transistor Mp1 and the node G1, and its gate terminal coupled to a node G2 at which current source $I_{ref2}$ and transistor M3 are coupled with each other.

Based on similar analysis for low gain current limiting module 30, the output current $I_{load}$ limited by the high gain limiting module 40 may be expressed as follow:

$$I_{load_highgain}=K*N*I_{ref2} \tag{9}$$

wherein the output current may be dominantly determined by $I_{ref2}$.

The high gain current limiting module 40 is configured to draw sudden peak of the output current $I_{load}$ back to a level determined by $I_{ref2}$. Low gain current limiting module 30 is configured to stabilize the output current $I_{load}$ from the level determined by $I_{ref2}$ to a final level determined by $I_{ref1}$. In various embodiments, the values of K, M, N, $I_{ref2}$, and $I_{ref3}$ should be selected to make sure that $I_{load_highgain}$ is greater than $I_{load_lowgain}$ in all cases.

In operation, when $I_{M3}$ is smaller than $I_{ref2}$, $M_{10}$ is turned off; and when $I_{M3}$ is greater than $I_{ref2}$, it may take some time, for example several nanoseconds, to turn on M10. When $I_{load}$ encounters a sudden peak, M10 is turned on and the current flowing through M10 may be very large. In that case, the gate voltage of power transistor Mp1 is pulled up to VINHSD and therefore Mp1 is turned off.

In order to avoid this scenario, high gain current limiting module 40 further comprises a second voltage clamping module. In one embodiment, the second voltage clamping module is two diodes D5 and D6 forwardly coupled in series between the drain terminal of M10 and the gate terminal of Mp1. This helps to clamp the gate voltage of Mp1 to be at least the sum of voltage drops across D5 and D6.

An NMOS transistor M9 is coupled between M7 and M2, and an NMOS transistor M11 is coupled between $I_{ref2}$ and M3. These transistors function as switches, with gate terminals of M9 and M11 coupled to an internal high voltage V3V_HSD.

The current limiting circuit further comprises a resistor R3 coupled between the gate terminal of the power transistor Mp1 and the node G1 for ESD protection, which is configured to separate inner driver block and the gate terminal of power transistor Mp1.

It will be readily understood by those skilled in the art that materials and methods may be varied while remaining within the scope of the present invention. It is also appreciated that the present invention provides many applicable inventive concepts other than the specific contexts used to illustrate embodiments. Accordingly, the appended claims are intended to include within their scope such processes, machines, manufacturing, compositions of matter, means, methods, or steps.

What is claimed is:

1. A method, comprising:

generating a gate voltage at a node in response to a constant reference current, said gate voltage applied to a gate terminal of a power transistor;

sensing an output current generated by the power transistor to generate a control current that is proportional to the sensed output current;

generating a first limiting current based on the control current;

generating a second limiting current based on the control current;

determining when a variation in the sensed output current exceeds a first threshold and in response thereto applying the first limiting current to said node;

determining when a variation in the sensed output current exceeds a second threshold and in response thereto applying the second limiting current to said node; and clamping said gate voltage in response to application of at least one of the first and second limiting currents to ensure that the power transistor does not completely turn off.

2. The method of claim 1, wherein the second limiting current is greater than the first limiting current.

3. A method, comprising:

generating a gate voltage at a node in response to a constant reference current, said gate voltage applied to a gate terminal of a power transistor;

sensing an output current generated by the power transistor to generate a control current that is proportional to the sensed output current;

generating a limiting current based on the control current;

determining when a variation in the sensed output current exceeds a threshold and in response thereto applying the limiting current to said node; and clamping a change in the gate voltage at said node so as to ensure that the gate voltage does not turn the power transistor completely off in response to application of the limiting current.

4. The method of claim 3, wherein the clamping comprises limiting a gate-to-source voltage of the power transistor to a voltage drop across a single diode.

5. A method, comprising:

generating a gate voltage at a node in response to a constant reference current, said gate voltage applied to a gate terminal of a power transistor;

sensing an output current generated by the power transistor to generate a control current that is proportional to the sensed output current;

generating a first limiting current based on the control current;

generating a second limiting current based on the control current;

determining when a variation in the sensed output current exceeds a first threshold and in response thereto applying the first limiting current to said node;

determining when a variation in the sensed output current exceeds a second threshold and in response thereto applying the second limiting current to said node; and clamping a change in the gate voltage at said node so as to ensure that the gate voltage does not turn the power transistor completely off in response to application of the second limiting current.

6. The method of claim 5, wherein the clamping comprises limiting a gate-to-source voltage of the power transistor to a voltage drop across a two series connected diodes.

7. The method of claim 5, wherein the second limiting current is greater than the first limiting current.

8. A method, comprising:

generating a gate voltage at a node in response to a constant reference current, said gate voltage applied to a gate terminal of a power transistor;

sensing an output current generated by the power transistor to generate a control current that is proportional to the sensed output current;

generating a first limiting current based on the control current;

generating a second limiting current based on the control current;

determining when a variation in the sensed output current exceeds a first threshold and in response thereto applying the first limiting current to said node;

determining when a variation in the sensed output current exceeds a second threshold and in response thereto applying the second limiting current to said node; and wherein generating the first limiting current based on the first current comprises:

applying a bias current to the node having a minimum magnitude;

sinking a sink current from the node having said minimum magnitude; and increasing the magnitude of the bias current in response to change in the control current due to variation in the sensed output current exceeding the first threshold.

9. The method of claim 8, wherein the second limiting current is greater than the first limiting current.

10. A method, comprising:

generating a gate voltage at a node in response to a constant reference current, said gate voltage applied to a gate terminal of a power transistor;

sensing an output current generated by the power transistor to generate a control current that is proportional to the sensed output current;

generating a first limiting current based on the control current;

generating a second limiting current based on the control current;

determining when a variation in the sensed output current exceeds a first threshold and in response thereto applying the first limiting current to said node;

determining when a variation in the sensed output current exceeds a second threshold and in response thereto applying the second limiting current to said node; and wherein generating the second limiting current comprises:

deactivating a current generator supplying the second limiting current when the variation in the sensed output current is less than the second threshold; and activating said current generator supplying the second limiting current when the variation in the sensed output current exceeds the second threshold.

11. The method of claim 10, wherein the second limiting current is greater than the first limiting current.

12. A method, comprising:

generating a gate voltage at a node for application to a gate terminal of a power transistor;

sensing an output current generated by the power transistor at an output node;

generating a first limiting current for application to said node, wherein generating the first limiting current comprises:

applying a bias current to the node having a minimum magnitude;

sinking a sink current from the having said minimum magnitude; and increasing the magnitude of the bias current in response to a sensed change in the output current exceeding a first threshold;

generating a second limiting current for application to said node, wherein generating the second limiting current comprises:

deactivating a current generator supplying the second limiting current if a sensed change the output current is less than a second threshold; and activating said current generator supplying the second limiting current in response to the sensed change in the output current exceeding the second threshold.

13. The method of claim 12, wherein the second limiting current is greater than the first limiting current.

14. The method of claim 12, further comprising clamping a change in the gate voltage at said node so as to ensure that the gate voltage does not turn the power transistor completely off in response to the first limiting current.

15. The method of claim 14, wherein the clamping comprises limiting a gate-to-source voltage of the power transistor to a voltage drop across a single diode.

16. The method of claim 12, further comprising clamping a change in the gate voltage at said node so as to ensure that the gate voltage does not turn the power transistor completely off in response to the second limiting current.

17. The method of claim 16, wherein the clamping comprises limiting a gate-to-source voltage of the power transistor to a voltage drop across a two series connected diodes.

18. The method of claim 12, further comprising maintaining the power transistor in an on state even if an output of the power transistor is shorted to ground.

* * * * *